US005365712A

United States Patent [19]

Muller

[11] Patent Number: 5,365,712

[45] Date of Patent: Nov. 22, 1994

[54] STRUCTURE FOR INTERCONNECTING TWO PART, SEPARATED BY AN EXPANSION JOINT, OF AN ASSEMBLY FORMING A VERY LONG BEAM, FOR EXAMPLE A BRIDGE DECK

[75] Inventor: Jean Muller, Suresnes, France

[73] Assignee: Societe Centrale D'etudes et de Realisations Routieres Scetauroute, Paris, France

[21] Appl. No.: 949,844

[22] PCT Filed: Apr. 3, 1992

[86] PCT. No.: PCT FR92/00301
§ 371 Date: Nov. 18, 1992
§ 102(e) Date: Nov. 18, 1992

[87] PCT Pub. No.: WO92/17647
PCT Pub. Date: Oct. 15, 1992

[30] Foreign Application Priority Data

Apr. 5, 1991 [FR] France ..... 91 04185

[51] Int. Cl.[5] ..... E04C 5/01

[52] U.S. Cl. ..... 52/573.1; 14/73.1

[58] Field of Search ..... 52/393, 395, 396, 402, 52/291, 1, 573, 632, 174; 14/73.1; 404/56, 57, 58, 59, 60, 61

[56] References Cited

U.S. PATENT DOCUMENTS

| | | | |
|---|---|---|---|
| 3,371,456 | 3/1968 | Balzer et al. | 52/395 |
| 3,390,501 | 7/1968 | Driggers | 52/395 |
| 3,604,322 | 9/1971 | Kester | 94/18 |
| 3,698,292 | 10/1972 | Koester | 94/18 |
| 3,904,303 | 9/1975 | Becht et al. | 404/68 |
| 3,907,443 | 9/1975 | McLean | 404/56 |
| 3,948,486 | 4/1976 | Jourdan et al. | 254/172 |
| 4,075,728 | 2/1978 | Puccio | 14/16.5 |
| 4,509,305 | 4/1985 | Guinard | 52/223 R |
| 5,051,024 | 9/1991 | Warthmann | 404/57 |

FOREIGN PATENT DOCUMENTS

| | | | |
|---|---|---|---|
| 642128 | 3/1962 | Canada | 52/174 |
| 0332954 | 9/1989 | European Pat. Off. | 52/396 |
| 2541334 | 8/1984 | France . | |
| 1954087 | 5/1971 | Germany . | |
| 2712091 | 10/1978 | Germany . | |
| 408089 | 9/1966 | Switzerland . | |

*Primary Examiner*—James L. Ridgill, Jr.
*Attorney, Agent, or Firm*—Watson, Cole, Grindle & Watson

[57] ABSTRACT

Structure intended to prevent a relative angular displacement on either side of an expansion joint (3) separating two parts (1, 2) of an assembly forming a very long beam, such as a bridge deck, in particular made from prestressed concrete, includes a rigid beam (8) arranged longitudinally on either side of the joint and resting on each part via two supports (9, 11, 13; 10, 12, 14) spaced apart longitudinally, so as to transmit a bending moment and/or a shearing force without inhibiting the expansions. At least one support is preferably provided with an adjusting jack (13, 14).

7 Claims, 2 Drawing Sheets

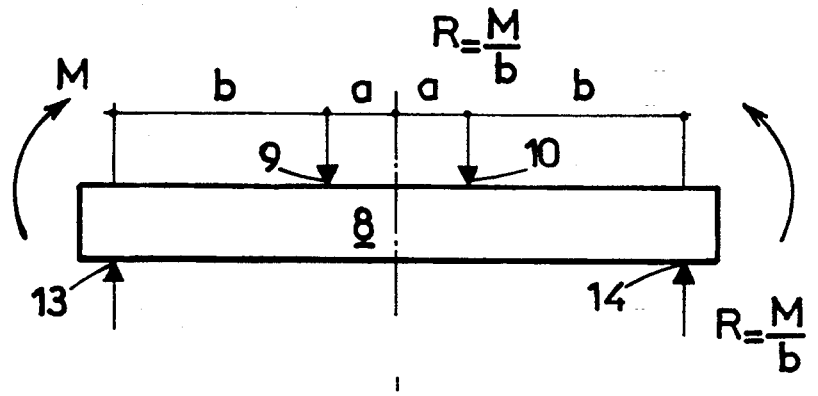
FIG.: 2A
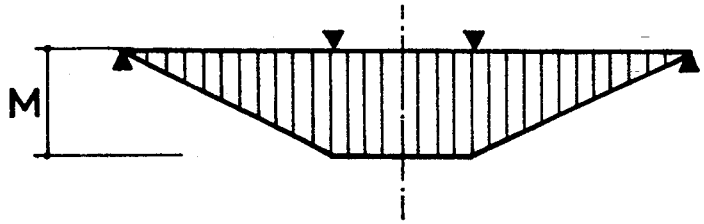
FIG.: 2B
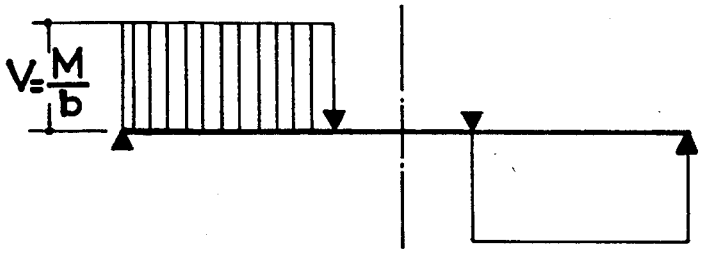
FIG.: 2C
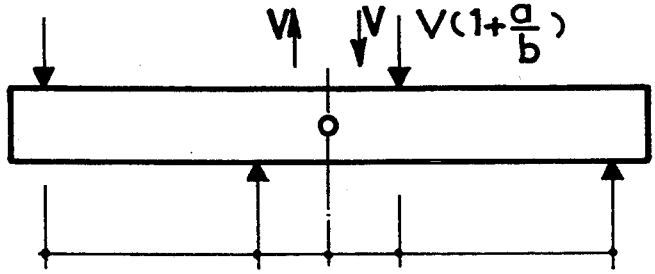
FIG.: 3A
FIG.: 3B
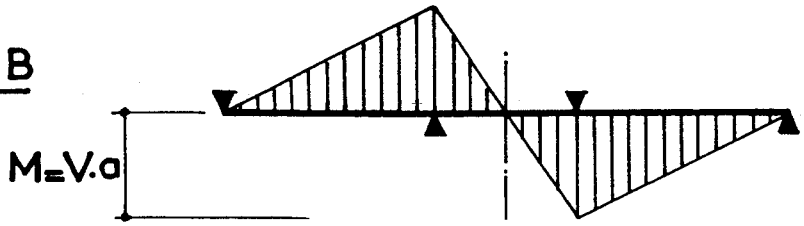
FIG.: 3C
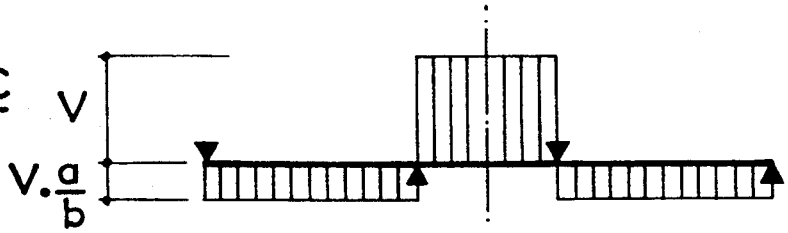

STRUCTURE FOR INTERCONNECTING TWO PART, SEPARATED BY AN EXPANSION JOINT, OF AN ASSEMBLY FORMING A VERY LONG BEAM, FOR EXAMPLE A BRIDGE DECK

BACKGROUND OF THE INVENTION

The present invention relates to a structure for interconnecting two elongated elements such as two parts of a bridge deck separated by an expansion joint, the parts for example made from prestressed concrete, or more generally of an assembly forming a very long beam.

Numerous prestressed-concrete bridges have been constructed by cantilevering with the aid of movable equipment, or by assembling prefabricated elements, the deck being constructed in successive stages symmetrically relative to the piers.

In the first structures of this type, an expansion joint was provided at the center of each span, at the joint between two facing cantilever arms. A mechanical device traversing the joint was provided to permit the expansions of the deck whilst preventing the relative vertical displacement of the two cantilever arms, the continuity of the roadway for highway bridges or the continuity of the rails for railroad bridges thus being ensured.

Such structures are simple to design and construct. However, the influence of the differential deformations of the concrete (creep) becomes very important when the spans exceed 40 to 50 meters, and considerable annular discontinuities in the vertical plane have appeared on numerous structures at all the expansion joints.

The most frequent angular discontinuity corresponds to an upward-pointing angle between the two deck parts, in other words with the joint forming a low point, but a downward-pointing angle can also occur, and irregularities in the material or the stresses can also result in angular deviations in the horizontal plane of the deck, or in relative torsion of one deck part with respect to the other.

In order to overcome the problem, mechanical continuity of the deck has been achieved at the center of the spans, the cantilever arms being assembled together to form a continuous beam.

For a very long structure, expansion joints must, however, be provided at gaps of a few hundred meters in order to ensure the free expansion of the deck.

If the joint is provided at the center of a span, the abovementioned problem of the angular discontinuity of the deck reoccurs. This means that the joint must be moved to a point one quarter of the width of the span, at the point of inflexion of the deformations, where the variations in moment created by the live loads are minimal. The solution is highly satisfactory in theory but its application in practice seriously complicates the construction as, during the latter, the mechanical continuity through the joint must be ensured to allow the remainder of the deck to be put in place.

In the German Patent Application No. 2712091 to Fritz Leonhardt, it was proposed to use jacks acting in the lengthwise direction of the bridge and arranged at points distant from the central part of the joint plane in order to exert forces tending to separate or bring together the facing parts of the deck. This arrangement makes it possible to counteract the appearance of angular discontinuities, but it cannot prevent dislocations in a transverse plane passing through the joint and resulting, in particular, from a relative vertical displacement, or a relative torsion, of the two deck parts.

The prior art thus makes it possible to counteract either vertical dislocations or angular discontinuities but it does not provide an adequate solution to the entire problem.

Similar problems occur at the location of the expansion joint which separates the end of the deck from the adjacent abutment. In what follows, two parts of a bridge deck will be referred to but it should be understood that it would not be going beyond the scope of the invention if one of these two parts consisted of one end of the deck and the other of the end of the adjacent abutment.

The initial object of the present invention is to provide a simple and economical solution to the entire problem of the discontinuities and dislocations of a bridge deck where at the location of the expansion joints. However, the invention can apply to any assembly forming a very long beam, and comprising at least two parts separated by an expansion joint.

SUMMARY OF THE INVENTION

In order to achieve this result, the invention provides a structure for interconnecting two parts, separated by a transverse expansion joint, of an assembly forming a very long beam, this structure comprising a device traversing the joint and preventing a relative displacement of the two parts of the assembly without inhibiting the expansions, the feature of this structure being that it comprises a rigid beach arranged longitudinally on either side of the expansion joint and connected to one part of the assembly by two supports spaced apart longitudinally, and to the other part of the assembly by two further supports spaced apart longitudinally, the beam and the supports being designed so as to transmit a bending moment and/or a shearing force without inhibiting the expansions.

In the case of a bridge, the moments and forces are exerted mainly in the vertical planes and the beam consequently rests on its supports, but supports acting in a horizontal direction, or obliquely to a transverse plane, are possible without going beyond the scope of the invention.

The beam is preferably metal in order to obtain the greatest rigidity with the minimum weight.

The structure of the invention makes it possible to place the expansion joint at the center of a span, where it is simplest to install.

At least one of the supports is preferably provided with at least one adjusting jack capable of exerting, between the beam and the adjacent part of the assembly, vertical forces which can be continuously adjusted. These jacks make it possible to compensate continuously the bending moments and possible shearing forces if the assembly is not symmetrical with respect to the expansion joint.

Such a design of the structure in theory makes it possible to cancel out completely all the undesirable effects of creep and thus to provide, in particular, a deck equipped with expansion joints at the center of certain spans which, however, behaves like a perfectly continuous structure under the effect of the permanent loads.

Behavior under the effect of variable live loads (trucks on a highway bridge or trains on a railroad bridge) cannot in practice be as perfect as for the case of the permanent loads. To eliminate completely the presence of the expansion joint and the break in the structure, it would require in this case the rigidity of the beam to restore exactly the continuity of the inertia of the assembly, which is generally impossible; additionally, the reaction forces imposed on the supports would be too high to be transmitted to the structure of the deck. In practice, however, the reduction in the deflections and angular discontinuities at the joint is considerable owing to the presence of the beam. The parameters of the system, which are the distances between the supports and between the latter and the expansion joint, and the inertia of the beam, can be optimized to obtain the best results for the controlling of all the deflections under permanent loads and live loads.

According to an advantageous practical embodiment, the beam is formed from two telescopic elements, each element being integral longitudinally with that part of the assembly on which it rests.

More advantageously, hydraulic means are provided which damp the relative momentary longitudinal displacements of the two elements of the beam. This option is particularly advantageous in the case of structures constructed in earthquake zones or for the transmission of longitudinal braking forces in railroad bridges.

BRIEF DESCRIPTION OF THE DRAWINGS

The invention will be explained in detail with the aid of practical examples illustrated with the drawings, among which:

FIGS. 2A to 2C are explanatory diagrams of the distribution of the stresses during the transfer of a moment.

FIGS. 3A to 3C are explanatory diagrams of the distribution of the stresses during the transfer of a shearing force.

DETAILED DESCRIPTION OF THE PREFERRED EMBODIMENTS

Figure 1:
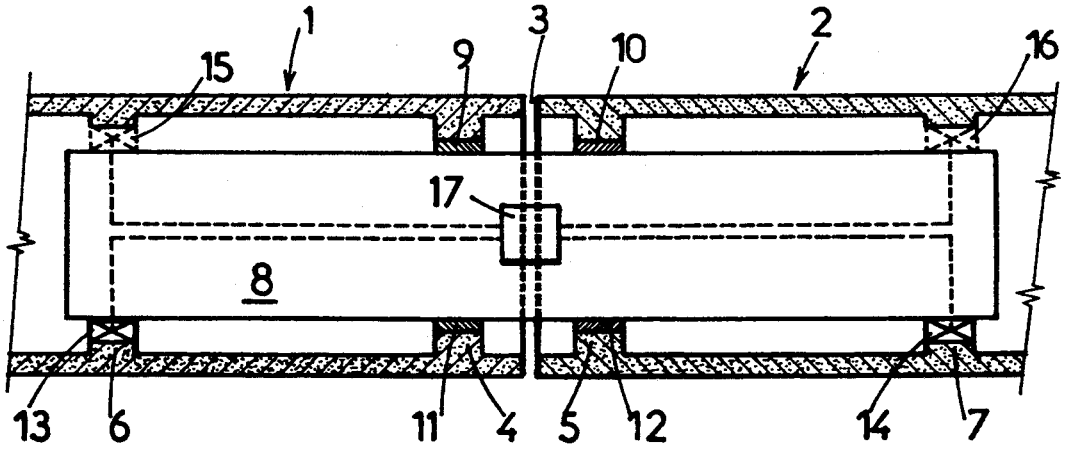
FIG. 1 is a diagrammatical section of a bridge portion comprising an expansion joint equipped with a device according to the invention.

FIG. 1 is a partial section of a bridge deck formed from closed-section box girders, taken along the middle longitudinal vertical plane of two successive box girders, this deck being equipped with a device according to the invention which is intended to counteract a tendency to an angular discontinuity forming an upward-pointing angle at the location of an expansion joint.

It is irrelevant here whether the deck consists of a series of longitudinally aligned box girders or of several similar series arranged in parallel.

Two deck parts 1, 2 are separated by an expansion joint 3.

The box girders forming the two deck parts each comprise a first transverse support wall 4, 5 situated in proximity to the expansion joint, and a second transverse support wall, 6, 7 situated further away from the expansion joint.

The transverse support walls 4 to 7 should be provided even in the case where the box girders are open at the bottom.

The walls 4 to 7 comprise, approximately at their center, a passage for a longitudinal beam 8 which constitutes an essential element of the invention.

The beam 8 must have a high rigidity with respect to bending in the vertical plane and is preferably made from steel to reduce its weight.

Where the beam 8 passes through the first support walls, it is held in place by upper support surfaces 9, 10 and lower support surfaces 11, 12. Where it passes through the second support walls, jacks 13, 14 are provided beneath the beam 8.

The support surfaces and the jacks are designed to permit the longitudinal displacements of the beam which correspond to the expansions.

FIGS. 2A to 2C illustrate the transmission of a bending moment M of the whole deck. If a is the distance from a first support wall 4, 5 to the expansion joint, and b the distance from the first support wall to the second support wall, it can be seen that the maximum moment M is sustained by the beam 8 over a length 2*a*, and that the shearing force $V=M/b$ acts on the beam over the two lengths b.

The distances a and b do not, of course, necessarily have to be identical on both sides of the expansion joint, for example in the case where this joint is situated between one end of the deck and the abutment. A person skilled in the art is capable of making the necessary calculations.

Where the device must compensate a moment in the opposite direction, corresponding to a tendency of the deck parts to form a downward-pointing angle, jacks must be provided which are placed above the beam, between the latter and the second support wall. These jacks have been shown by broken lines with the reference 15, 16.

The support surfaces 11, 12 situated beneath the beam and which play no role in the above scenario then become active and must consequently be included in the calculations.

The jacks 13 to 16 are of any appropriate type, whether hydraulic, electric or mechanical, for example screw jacks. They are controlled by signals emitted by sensors 17 which are capable of detecting the relative position of the deck parts. The jacks apply a force to the beam 8 transverse to the direction of longitudinal expansion of the deck parts 1,2.

It is possible to switch round the positions of the support surfaces 9 to 12 and of the jacks 13 to 16, by placing the support surfaces on the second support walls and the jacks on the first support walls, on the two deck parts or on only one of them.

The provision of jacks and support surfaces above and beneath the beam 8 makes it possible, in addition to transmitting a moment, to transmit a shearing force tending to create a difference in level at the location of the joint 3. As shown in FIGS. 3A to 3C, the beach 8 is subjected, at the first support wall 4, 5 to a maximum moment $V/a$ and to a shearing force V between the two first support walls, and to a shearing force $V \times a/b$ between the first and second support walls.

If one wanted to compensate just a shearing force in a given direction, for example in the case of a bridge end, FIGS. 3A to 3C show that one could just keep a jack situated above the bee on one deck part, and a jack situated beneath the beam on the other deck part.

In the above, it has been assumed that the moments or shearing forces are exerted in a vertical plane. If moments or shearing forces which are exerted in a horizontal plane need to be counteracted, the same reasoning applies. FIG. 1, for example, can illustrate a horizontal section of a deck or of a deck part, and the same goes for FIGS. 2A and 3A.

In order to counteract torsional strains in the deck, the beam 8 can be given an appropriate section, and the support surfaces and jacks can be placed appropriately, in accordance with the rules familiar to a person skilled in the art. A plurality of beams can also be placed in parallel. This latter solution is particularly suitable when the deck consists of two or more series of box girders arranged parallel to the axis of the structure. A beam is then placed in at least two series of box girders.

Figure 4:
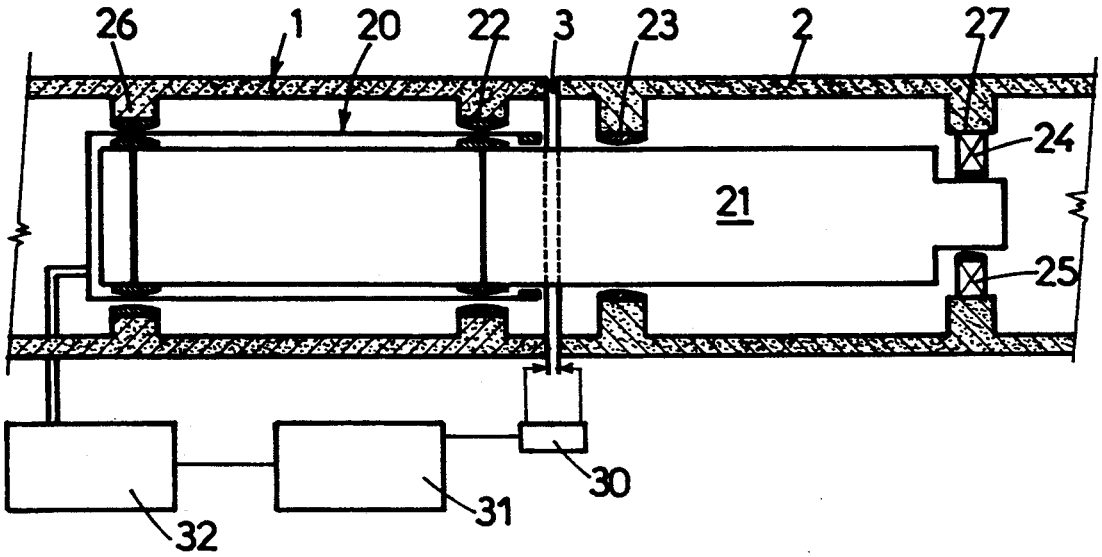
FIG. 4 is a diagrammatic section, similar to that in FIG. 1, relating to another embodiment of the invention.

FIG. 4 shows another embodiment of the invention, in which the beam 8 is constructed in the form of a hydraulic jack comprising a body 20 and a piston 21 sliding inside it (FIGS. 4 and 5). The body 20 is fixed to one of the two deck parts 1, whilst the piston 21 is fixed to the other part 2. The supports 22 and 23 nearest the joint 3 can be fixed since the expansion of the deck is ensured by the relative movement of the two parts of the jack (body 20 and piston 21). The adjusting members such as the jacks 24, 25 are placed on either or both of the two end support walls 26 and 27.

The reference 30 represents a sensor capable of detecting the spacing between the edges of the expansion joint 3, or the forces which are exerted on this joint. The signals from the sensor 30 are processed in an electronic circuit 31 which discriminates the slow variations in these spacings or forces which correspond to thermal expansion phenomena, and the sudden variations which correspond to accidental phenomena such as those caused by an earthquake or the braking of a train in the case of a railroad viaduct. The signals corresponding to the sudden variations serve to control a hydraulic circuit 32 which controls an appropriate variation in the pressure of the fluid in the hydraulic jack 20 in order to damp and/or reduce the relative longitudinal displacements of the two deck parts.

It is claimed:

1. The combination of a first and second elongated elements of an assembly of elements which form a beam structure, said first and second elongated elements being separated by a transverse expansion joint, and a rigid support beam means for interconnecting said first and second elongated elements and preventing at least one of bending and shearing movements between said first and second elongated elements while allowing longitudinal expansions of said first and second elongated elements, said first and second elongated elements each providing first and second internal support means along a length thereof, said first support means being located between said transverse expansion joint and second support means, said support beach means extending across said transverse expansion joint and within said first and second elongated elements such that it extends from said second support means in said first elongated element to said second support means in said second elongated element, said support beams means being in contact with at least said first support means in said first and second elongated elements, and an adjustable jack positioned between said second support means in said first elongated element and said support beam for continuously adjusting a force applied between said support beam and said first elongated element transverse to a direction of longitudinal expansion of said first and second elongated elements.

2. The combination according to claim 1, including sensor means for detecting relative positioning of said first and second elongated elements and for controlling said adjustable jack.

3. The combination according to claim 1, wherein said support beam means comprises first and second beam parts which are respectively connected to said first and second elongated elements and are telescopically connected together.

4. The combination according to claim 3, including hydraulic means connected to said support beam means to damp longitudinal telescopic movements of said first and second beam parts relative to one another.

5. The combination according to claim 4, including sensor means for detecting relative positioning of said first and second elongated elements and for controlling said hydraulic means.

6. The combination of first and second elongated elements of an assembly of elements which form a beam structure, said first and second elongated elements being separated by a transverse expansion joint, and a rigid support beam means for interconnecting said first and second elongated elements and preventing at least one of bending and shearing movements between said first and second elongated elements while allowing longitudinal expansions of said first and second elongated elements, said first and second elongated elements each providing first and second internal support means along a length thereof, said first support means being located between said transverse expansion joint and said second support means, said support beams means extending across said transverse expansion joint and within said first and second elongated elements such that it extends from said second support means in said first elongated element to said second support means in said second elongated element, said support beam means being in contact with at least said second support means in said first and second elongated elements, and an adjustable jack positioned between said first support means in said first elongated element and said support beam for continuously adjusting a force applied between said support beam and said first elongated element transverse to a direction of longitudinal expansion of said first and second elongated elements.

7. The combination according to claim 6, including sensor means for detecting relative positioning of said first and second elongated elements and for controlling adjustable jack.

* * * * *

UNITED STATES PATENT AND TRADEMARK OFFICE

CERTIFICATE OF CORRECTION

PATENT NO. : 5,365,712

DATED : November 22, 1994

INVENTOR(S) : Jean MULLER

It is certified that error appears in the above-indentified patent and that said Letters Patent is hereby corrected as shown below:

On the title page item [54], should read as follows:

STRUCTURE FOR INTERCONNECTING
TWO PARTS, SEPARATED BY AN
EXPANSION JOINT, OF AN ASSEMBLY
FORMING A VERY LONG BEAM, FOR
EXAMPLE A BRIDGE DECK

Signed and Sealed this

Twenty-first Day of February, 1995

*Attest:*

Bruce Lehman

BRUCE LEHMAN

*Attesting Officer*

*Commissioner of Patents and Trademarks*